US005150505A

United States Patent [19]

Drabek

[11] Patent Number: 5,150,505

[45] Date of Patent: Sep. 29, 1992

[54] HAND TOOL FOR FASTENING SNAPS

[76] Inventor: David F. Drabek, 245 Seabury Rd., Bolingbrook, Ill. 60439

[21] Appl. No.: 612,888

[22] Filed: Nov. 13, 1990

[51] Int. Cl.[5] ..... B25B 27/14

[52] U.S. Cl. ..... 29/278; 81/486; 81/488

[58] Field of Search ..... 7/169, 170; 29/278, 29/280, 283, 270; 81/486, 485, 488; 24/40

[56] References Cited

U.S. PATENT DOCUMENTS

| | | | |
|---|---|---|---|
| 511,481 | 12/1893 | Williams . | |
| 715,858 | 12/1902 | Pfenning . | |
| 1,291,563 | 1/1919 | Laughlin . | |
| 1,306,790 | 6/1919 | Vogel . | |
| 2,103,008 | 12/1937 | Kinast . | |
| 2,571,943 | 10/1951 | Ray et al. . | |
| 2,912,733 | 11/1959 | Layman . | |
| 3,683,459 | 8/1972 | Johansen . | |
| 3,819,221 | 6/1974 | O'Connor . | |
| 3,918,140 | 11/1975 | Konstant | 29/278 |
| 3,936,088 | 2/1976 | Williams . | |
| 4,096,618 | 6/1978 | Perline et al. | 29/278 |
| 4,108,026 | 8/1978 | Anderson et al. . | |

*Primary Examiner*—Roscoe V. Parker

*Attorney, Agent, or Firm*—Deborah Schavey Ruff; Steven L. Underwood

[57] ABSTRACT

An improved hand tool is presented that is useful to pull or push the base of the female member of a snap fastener provided on a heavy fabric-like covering. By pushing or pulling on the female snap member substantially along the plane of the fabric, the snap member can be positioned over a corresponding male snap member for secure fastening. The tool comprises a handle member, an arm, and a force member, which is further provided with tension and compression notches. The tool thus gives the operator a means to positively grasp the female snap member and efficiently apply tension to the fabric covering so as to stretch the covering into the proper shape without substantial damage to the fabric-like covering.

5 Claims, 4 Drawing Sheets

HAND TOOL FOR FASTENING SNAPS

BACKGROUND OF THE INVENTION

1. Field of the Invention

This invention relates to a hand tool for use in fastening snap fasteners and more particularly to an inexpensive, compact, integrated, multi-directional hand-held device for use in positioning a female snap member proximate a corresponding male snap member to facilitate the positive coupling of the female snap members disposed on heavy fabric-like materials to male snap members disposed on fixed structures.

2. Description of the Prior Art

Many methods have been devised to attach heavy fabric-like coverings, such as canvas, polyester, leather, and tarpaulin to fixed structures. One method commonly used, for example, in automobile convertible top boots, boat covers, and recreational vehicle coverings, are snap fasteners. These fasteners most usually comprise female snap members located about the periphery of the covering and corresponding male snap members rigidly attached to a fixed structure. The male snap members generally define the open area to be covered by the covering material.

In virtually all such attachment methods using snap fasteners, the users of the coverings have been required to manipulate the covering and snap fasteners by hand. Manipulation by hand, however, is often an arduous and difficult process.

For example, usually both hands of the user or multiple users are required to firmly grasp the covering and/or snap fastener to position and secure the snap fastener. This creates difficulties where the snap fastener may be accessible by only one hand. The tension or resistance to movement of the cover can also make one-handled operations impossible, especially for children, the elderly, or physically impaired individuals. Further, the snap fastener is often beyond the reach of the user, requiring the user to climb upon the fixed structure, or some other nearby structure, generally at great personal risk.

Also, manipulation of the covering and/or snap fastener by hand can contribute to injury of the user's hands or arms. Especially when wet, the covering and/or snap fastener can become quite slippery, causing the hands of the user to abruptly slip away at a moment when great force to the covering is being applied. The effort thus exerted by the user can result in impact of the user's hands or arms into surrounding rigid structures, causing injury.

The prior art contains many disclosures of devices and tools for assisting in the attachment of fasteners. These disclosures generally reveal a hand tool having a handle attached to a shank, where the shank head can be used to pull on the fastener member. However, nowhere in these disclosures is it suggested that the tool could assist the positioning and fastening of a female snap fastener, mounted on a heavy fabric-like covering, to a male snap member mounted on a fixed structure. Although some disclosures do reveal tools that can be used to assist in the fastening of a snap fastener, these tools uniformly fail to disclose a multi-directional hand tool usable by either hand which engages the female snap member along two possible force directions, each force direction within a plane substantially parallel to the plane defined by the surface of the fabric so as to guide it into position under the tension created by the stretched heavy fabric-like covering.

SUMMARY OF THE INVENTION

The present invention evolved with the general object of providing improvements upon the prior art tools, particularly with respect to obtaining optimum utility while maintaining the durability of the fabric-like covering or substrate material.

An important aspect of the invention relates to the recognition and discovery of problems with prior art tools and their causes and to an analysis of what is necessary to overcome such problems and otherwise provide an improved tool. It is found that although the aforementioned tools may be used generally satisfactorily for the fastener applications for which they are designed, potential problems may arise which operate under other conditions. In particular, the present invention is capable of assisting the positioning of the female snap member in multiple directions relative to the position of the tool operator. Further, the amount of useful force transmitted by the aforementioned tools is often limited by the geometrical relationship between the desired direction of travel and the actual direction of force. The positioning or horizontal force that is actually applied to the female snap member is equal to only the product of the cosine of the angle created between the tool shank and the fabric surface times the actual force applied by the tool operator.

Moreover, an undesired simultaneous vertical force is applied equal to the product of the sine of this angle times the applied force. Accordingly, the tool often is urged to slip off the female snap member by this vertical force. Further, past tools engage the female snap member so as to generate a twisting moment about an axis transverse to the plane of the female snap member. These moments are created by the applied force acting over a vertical distance above the fabric surface, often defined by the vertical height of the female snap member. This undesired moment tends to rotate the female snap member about a horizontal line on a plane transverse to the plane of the heavy fabric-like material and can excessively stretch the fabric surface adjacent to the female snap member, potentially reducing the durability of the fabric in that area. The result of these shortcomings is that appreciable effort and repeated attempts are necessary to successfully position the female snap member proximate the male snap member and the durability of the entire fabric-like cover can be reduced.

In accordance with this invention, as the force is applied generally parallel to the surface of the fabric, the angle created between the tool shank and the fabric surface is reduced to substantially zero. Thus, the full force applied to the female snap member may be beneficially employed to position the female snap proximate the male snap member, without risk of tool disengagement. Further, the tool of the present invention engages the female snap member so as to minimize twisting moments about the female snap member created by the applied force acting over a vertical distance above the fabric surface Accordingly, the moment which tends to rotate the female snap member about a horizontal line is reduced, as is the potential for excessive stretching of the fabric surface adjacent to the female snap member. The durability of the fabric in that area is correspondingly improved.

More particularly, an improved hand tool is presented that is useful to pull or push the base of the female member of a snap fastener provided on a heavy fabric-like covering. By pushing or pulling on the female snap member along the plane of the fabric, the snap member can be positioned over the corresponding male snap member and the fastener can then be securely engaged. The tool thus gives the operator a means to confidently grasp the female snap member and efficiently apply tension to the fabric covering so as to stretch the covering into the proper shape without substantial damage to the fabric-like covering.

Accordingly, it is an objective of this invention to provide an improved hand tool capable of assisting the positioning of the female snap member in multiple directions relative to the position of the tool operator.

It is a further objective of this invention to increase the amount of useful force transmitted by the aforementioned tools by improving the geometrical relationship between the desired direction of travel and the actual direction of force so that the force applied by the tool operator is substantially equal to the actual force applied to the female snap member.

It is also an objective of this invention that undesired vertical forces be minimized to prevent the tool from slipping off the female snap member.

It is a final objective of this invention to substantially eliminate twisting moments about the female snap member which tend to rotate the female snap member about a horizontal line, excessively stretching the fabric surface adjacent to the female snap member, and potentially reducing the durability of the fabric in that area.

These and other objects of the this invention may be determined by a review and understanding of the following disclosure.

Figure 1:
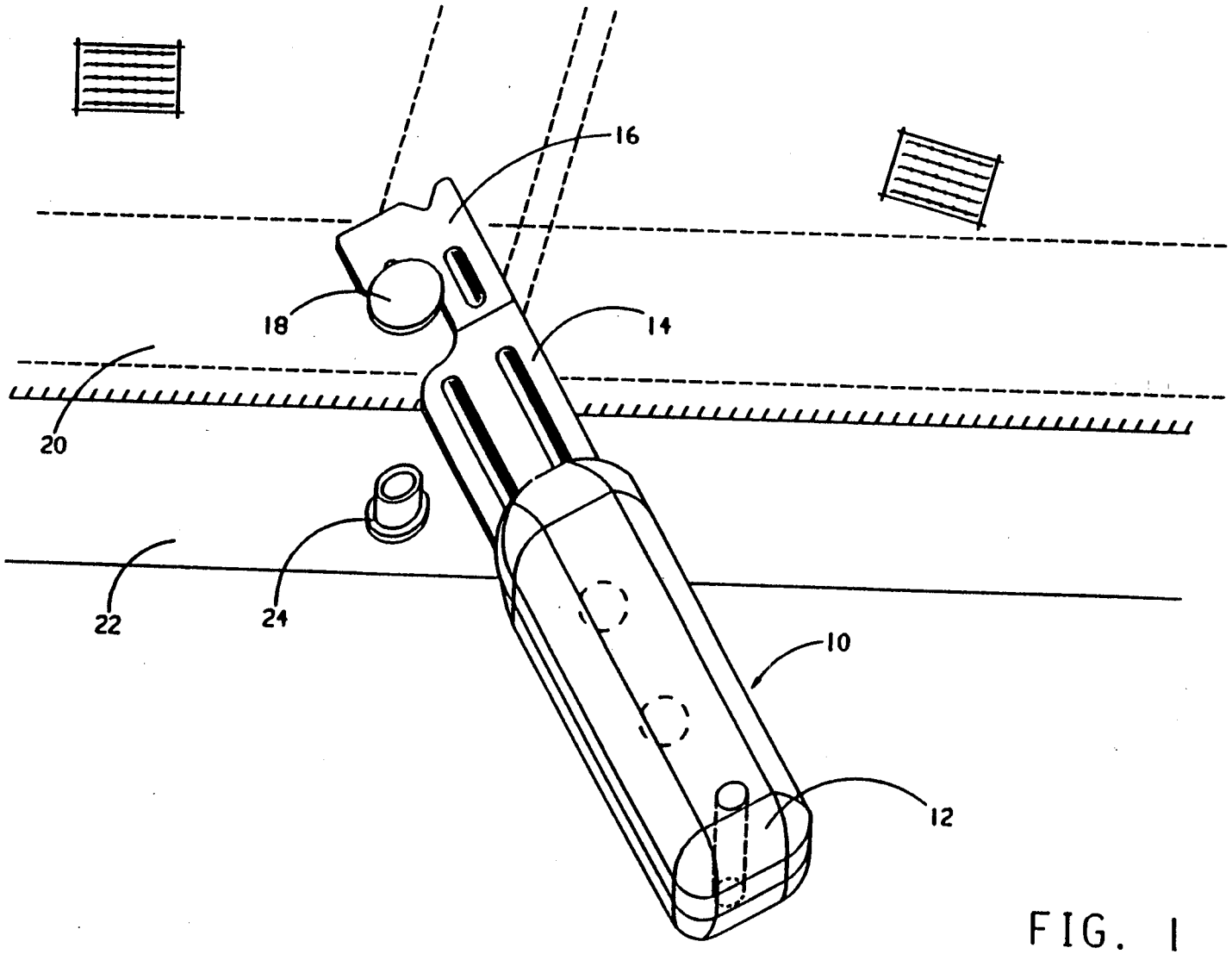
FIG. 1 is an overall schematic of the hand tool manipulating snap members according to the present invention.

It should be understood that the drawings are not necessarily to exact scale and that certain aspects of the embodiments are illustrated by graphic symbols, schematic representations and fragmentary views. It should also be understood that when referring to physical relationships of components by terms such as "upper", "lower", "upward", "downward", "vertical", "horizontal", "left", "right" or the like, such terms have reference solely to the orientation depicted in the drawings, Actual embodiments or installations thereof may differ.

While much mechanical detail, including other plan and section views of the particular embodiment depicting have been omitted, such detail is not per se part of the present invention and is considered well within the comprehension of those skilled in the art in the light of the present disclosure. The resulting simplified presentation is believed to be more readable and informative and readily understandable by those skilled in the art. It should also be understood, of course, that the invention is not limited to the particular embodiment illustrated.

DETAILED DESCRIPTION OF THE PREFERRED EMBODIMENTS

Referring to the figures, wherein like reference characters designate like or corresponding parts throughout the views, FIG. 1 illustrates the overall configuration and function of the preferred embodiment of the hand tool according to the present invention. The tool 10 may be generally considered in three portions—handle 12, arm 14, and force member 16. As shown, force member 16 is engaging an edge of a female snap member 18. The female snap member 18 is fixedly attached in a conventional manner to an edge portion of heavy fabric-like cover 20.

Located on a rigid structure 22 is a corresponding male snap member 24. When the female snap member 18 is brought into sufficient proximity above the male snap member 24, the female snap member 18 can be readily forced downward to positively couple with the male snap member 24. This coupled fastener is effective to restrain the heavy fabric-like cover 20 in position over the rigid structure 22 until affirmatively detached by uncoupling the snap members 18, 24.

Figure 2:
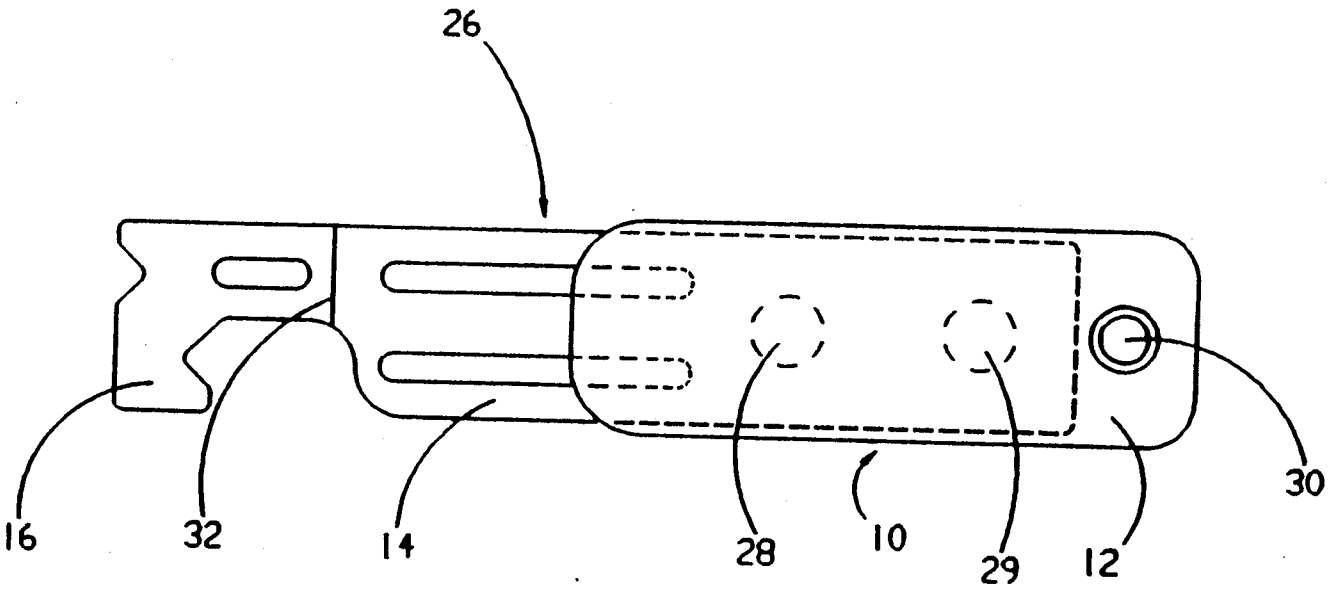
FIG. 2 is a plan view of the hand tool according to the present invention shown in FIG. 1.

Referring to FIG. 2, the hand tool 10 of the present invention is shown in greater detail. The handle 12 is molded from conventional thermoplastic resin materials to form a means to grasp the tool 10. Accordingly, it is preferred that the handle 12 is textured to provide a more positive grasping surface. The handle 12 is formed in place about the stamped and formed blank 26, which will be discussed in greater detail. The blank 26 is provided with a first aperture 28 and a second aperture 29, which receive the thermoplastic resin during the molding process and accordingly create a solid plug restraining the handle 12 from separating from the blank 26. The handle 12 is further molded to create an orifice 30, through which a flexible cord or other like component (not shown) can be threaded. This allows the tool 10 to be conveniently stored or hung in proximity when not in use.

Figure 3:
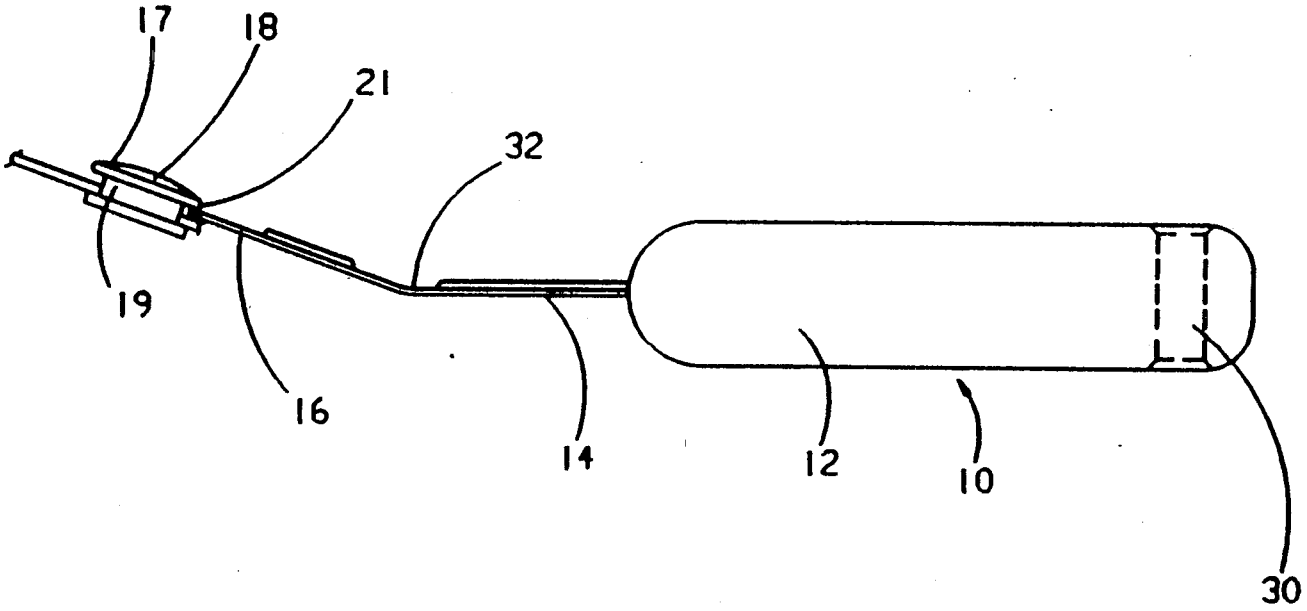
FIG. 3 is a side view of the hand tool according to the present invention shown in FIG. 2, showing in greater detail the handle.

The arm 14 and the force member 16 are separated by a bend 32, best viewed in FIG. 3, which provides for substantially planar force only during the operation of the tool 10, while also allowing the operator to positively grasp the handle 12. Also best seen in FIG. 3, the female snap member 18 of the conventional design is further comprised of a collar 19, which is of smaller diameter than the crown 17. Thus, a lip 21 is formed, which is advantageously exploited by the present invention.

Figure 4:
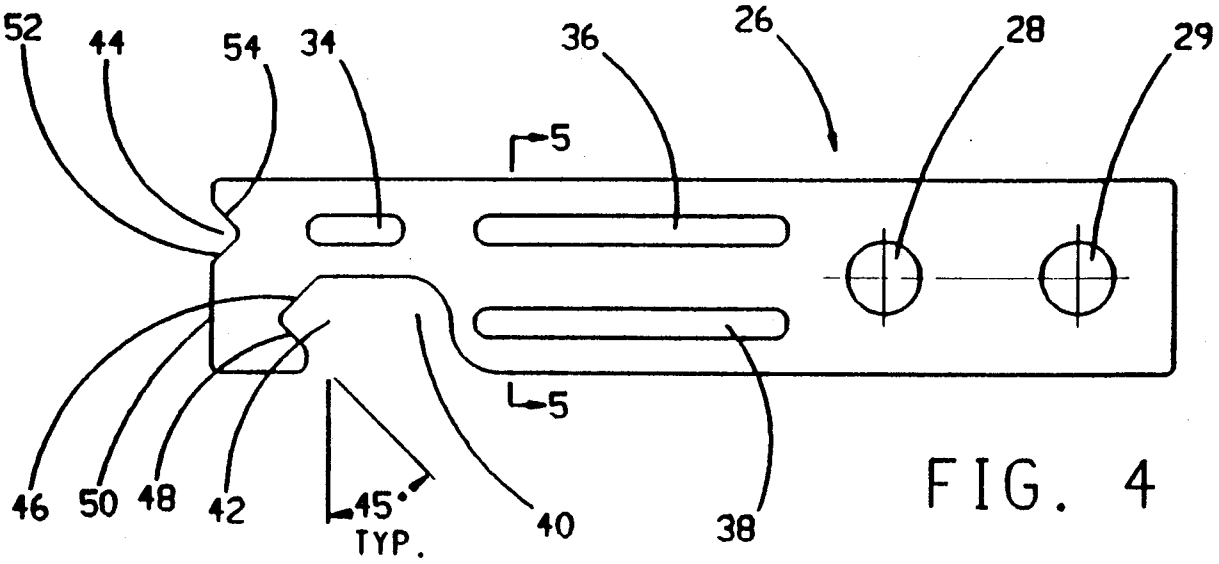
FIG. 4 is a plan view of the hand tool operative member according to the present invention prior to complete manufacture.
Figure 6:
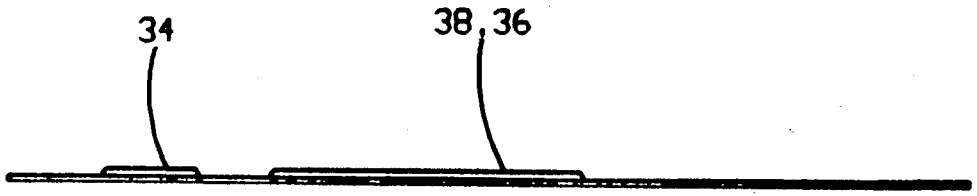
FIG. 6 is a side view of the hand tool operative member according to the present invention shown in FIG. 4.
Figure 5:
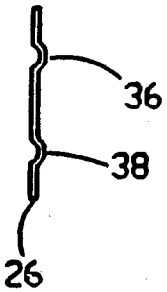
FIG. 5 is a sectional view of the hand tool operative member according to the present invention prior to complete manufacture along the line 5—5 shown in FIG. 4.

Referring to FIG. 4, the blank 26 may be viewed prior to the forming of the handle 12. The blank 26 is preferably stamped from 0.031 inch thick 303 stainless steel. Using well known progressive die methods, the steel sheet is perforated to provide apertures 28 and 29. Stiffing beads 34, 36, and 38 (best viewed in FIGS. 5 and 6) are then formed, each having a 0.060 inch radius. Finally, the blank 26 shape, seen in FIG. 4, is provided with cutout 40 (defined by a 0.25 inch radius), tension notch 42 and compression notch 44. The tension notch 42 is further defined by inside edge 46 and outside edge 48, arranged to create a 90 degree angle. Each edge 46 and 48 is set at an angle of 45 degrees to the leading edge 50 of the blank 26. The compression notch 44 is likewise defined by inside edge 52 and outside edge 54, also arranged to create a 90 degree angle. Each edge 52 and 54 is set at an angle of 45 degrees to the leading edge 50 of the blank 26. This configuration has been found to encourage ready separation of the tool 10 from the female snap member 18 after the female snap member 18 and the male snap member 24 have been fastened.

In operation, as best viewed in FIG. 1, the female snap member 18 is engaged by either the tension notch 42 (as shown) or the compression notch 44. As thus engaged, the female snap member can then be manipulated by either tension or compression (depending on the relative position of the tool operator to the male snap member 24) to a position proximate the male snap member 24. By engaging the female snap member 18 in such a manner, the force member 16 exerts a force in a plane substantially parallel to the plane of the heavy fabric-like covering 20. Accordingly, the female snap member 18 is subjected to little, if any, twisting moments and all the force acting through the force member 16 is advantageously used to manipulate the female snap member 18. Further, the force member 16 is not induced to slip off of the female snap member due to the force direction being exerted against the collar 19 and below the lip 21 of the female snap member 18 in substantially the plane of the cover 20.

A bend 32, as seen in FIGS. 2 and 3, may also be added by the tool user depending on the specific orientation of the female snap member 18 to the male snap member 24 during the operation noted above. The thin gauge thickness, preferable 0.031 inch, of the stainless steel blank 36 makes such bending easily accomplished. Thus, the user can achieve the greatest benefit of the invention herein disclosed by simply supplying the bend 32 so as to provide substantially coplanar force application, regardless of the initial orientation of the user to the female snap member 18 and the male snap member 24.

It will be understood that the details, materials and arrangements of parts of specific embodiments have been described and illustrated to explain the nature of the invention. Changes may be made by those skilled in the art without departing from the invention as expressed in the appended claims.

What is claimed is:

1. A hand tool for facilitating the coupling of a male and female snap fastener member, wherein said female snap member is fixedly mounted on a substrate material, said hand tool comprising:

first means to engage in tension said female snap member attached to said substrate material, said first means comprising a tension notch edge, said tension notch edge being capable of engaging in tension said female snap member attached to said substrate material, second means to engage in compression said female member of a snap fastener attached to a substrate material, said second means comprising a compression notch edge, said compression notch edge being capable of engaging in compression said female snap member attached to said substrate material, and handle means, said handle means comprising a textured thermoplastic resin material formed about said hand tool so as to allow the exertion of a tensile or compressive force through said first or second means engaging said female snap member attached to said substrate material;

said first and second means being adapted to selectively apply a bi-directional force exerted through said handle means to said female snap member within a plane substantially along the plane of the said substrate material, and said first and second means engaging said female snap member attached to said substrate material such that tensile or compressive forces exerted through said first and second means creates substantially zero rotational moments about an axis located in the transverse plane of said substrate material.

2. A hand tool for facilitating the coupling of a male and female snap fastener member, wherein said female snap member is fixedly mounted on a substrate material, said hand tool comprising:

a first means for engaging in tension said female snap member attached to said substrate material;

second means for engaging in compression said female snap member attached to said substrate material; and textured thermoplastic resin handle means formed about said hand tool so as to allow the exertion of a tensile or compressive force through said first or second means for engaging said female snap member attached to said substrate material;

said first and second means being adapted to selectively apply a bi-directional force exerted through said handle means to said female snap member within a plane substantially along the plane of said substrate material.

3. A hand tool for facilitating the coupling of a male and female snap fastener member, wherein said female snap member is fixedly mounted on a substrate material, said hand tool comprising:

first means for engaging in tension and second means for engaging in compression said female member of a snap fastener attached to a substrate material; and handle means further comprising a textured thermoplastic resin material injection molded about said first and second means;

said first and second means and being combined in a single stamped blank integrated with said handle means and adapted to selectively apply a bi-directional force exerted through said handle means so as to allow the exertion of a tensile or compressive force through said first or second means engaging said female snap member within a plane substantially along the plane of said substrate material.

4. A hand tool for facilitating the coupling of a male and female snap fastener member, wherein said female snap member is fixedly mounted on a substrate material, said hand tool comprising:

first means for engaging in tension said female snap member attached to said substrate material;

second means for engaging in compression said female member of a snap fastener attached to a substrate material; and handle means further comprising a textured thermoplastic resin material formed about said hand tool;

said first and second means being adapted to selectively apply a bi-directional force exerted through said handle means so as to allow the exertion of tensile or compressive force through said first or second means engaging said female snap member attached to said substrate material within a plane substantially along the plane of said substrate material.

5. A hand tool for facilitating the coupling of a male and female snap fastener member, wherein said female snap member is fixedly mounted on substrate material forming a cover, said hand tool comprising:

first means for releasably engaging a portion of said female snap member attached to said substrate material in tension;

second means for releasably engaging a portion of said female member of a snap fastener attached to a substrate material in compression; and integral handle means further comprising a textured thermoplastic resin material formed about said hand tool so as to allow the exertion of a tensile or compressive force through said first or second means engaging said female snap member attached to said substrate material;

said first and second means being adapted to selectively apply a bi-directional force exerted through said integral handle means to said female snap member within a plane substantially along the plane of said substrate material; and said first and second means engaging said female snap member attached to said substrate material such that tensile or compressive forces exerted through said first and second means creates substantially zero rotational moments about an axis located in the transverse plane of said substrate material.

* * * * *